US006974393B2

(12) United States Patent
Caldwell et al.

(10) Patent No.: US 6,974,393 B2
(45) Date of Patent: Dec. 13, 2005

(54) GOLF CLUB HEAD

(75) Inventors: Bruce G. Caldwell, La Quinta, CA (US); Franklin L. Gage, Chula Vista, CA (US); Michael A. Bluff, Sr., Riverside, CA (US); Ronald G. Holder, Laguna Niguel, CA (US)

(73) Assignee: CeramixGolf.com, Carlsbad, CA (US)

( * ) Notice: Subject to any disclaimer, the term of this patent is extended or adjusted under 35 U.S.C. 154(b) by 60 days.

(21) Appl. No.: 10/327,584

(22) Filed: Dec. 20, 2002

(65) Prior Publication Data

US 2004/0121853 A1 Jun. 24, 2004

(51) Int. Cl.[7] ..... A63B 53/04

(52) U.S. Cl. ..... 473/324; 473/349; 473/338; 473/345; 473/346; 273/DIG. 7

(58) Field of Search ..... 473/324, 345, 473/346, 349, 338, 291, 344, 347, 348; 273/DIG. 7

(56) References Cited

U.S. PATENT DOCUMENTS

| | | | | |
|---|---|---|---|---|
| 4,139,196 A | | 2/1979 | Riley | |
| 4,432,549 A | | 2/1984 | Zebelean | |
| 4,438,931 A | | 3/1984 | Motomiya | |
| 4,519,612 A | * | 5/1985 | Tsao | 473/248 |
| 4,535,990 A | * | 8/1985 | Yamada | 473/346 |
| 4,795,159 A | | 1/1989 | Nagamoto | |
| 4,872,685 A | * | 10/1989 | Sun | 473/349 |
| 5,213,328 A | * | 5/1993 | Long et al. | 473/346 |
| 5,213,329 A | * | 5/1993 | Okumoto et al. | 473/328 |
| 5,316,305 A | | 5/1994 | McCabe | |
| 5,342,812 A | | 8/1994 | Niskanen et al. | |
| 5,429,365 A | * | 7/1995 | McKeighen | 473/346 |
| 5,582,553 A | * | 12/1996 | Ashcraft et al. | 473/345 |
| 5,649,873 A | | 7/1997 | Fuller | |
| 5,711,722 A | * | 1/1998 | Miyajima et al. | 473/346 |
| 5,890,973 A | * | 4/1999 | Gamble | 473/326 |
| 5,911,638 A | | 6/1999 | Parente et al. | |
| 5,941,782 A | * | 8/1999 | Cook | 473/346 |
| 5,971,867 A | * | 10/1999 | Galy | 473/345 |
| 6,042,486 A | | 3/2000 | Gallagher | |
| 6,149,534 A | * | 11/2000 | Peters et al. | 473/345 |
| 6,159,109 A | | 12/2000 | Langslet | |
| 6,162,132 A | | 12/2000 | Yoneyama | |
| 6,306,048 B1 | | 10/2001 | McCabe et al. | |
| 6,440,008 B2 | | 8/2002 | Murphy et al. | |
| 6,464,599 B1 | * | 10/2002 | Wolf | 473/328 |

* cited by examiner

*Primary Examiner*—Sebastiano Passaniti
(74) *Attorney, Agent, or Firm*—Gordon & Rees LLP

(57) ABSTRACT

A golf club head has a body with a front, striking face, a rear face, an upper face and a lower face. A lightweight sole plate of glass fiber reinforced plastic material is secured across the lower face of the body.

16 Claims, 2 Drawing Sheets

GOLF CLUB HEAD

BACKGROUND OF THE INVENTION

The present invention relates generally to golf clubs, and is particularly concerned with a golf club head having a sole plate of non-metallic material.

Up to now, most golf club heads have had metal sole plates. In many cases, the entire head is of metal. Some club heads are made of non-metallic materials, but these often have a metal sole plate. U.S. Pat. No. 4,795,159 of Nagamoto describes a wood-type golf club head formed from a shell of fiber reinforced plastic. A sole plate is secured to the lower face of the shell, the plate having an outer layer of metallic material and an inner layer of synthetic resin material.

One disadvantage of metal sole plates is that the weight of the metal tends to lower the center of gravity of the golf club head. As the center of gravity is lowered, the trajectory of the golf ball is higher. Professional or very low handicap golfers have to go to very low loft clubs in order to overcome the high trajectory resulting from a heavier sole plate. Low loft clubs, i.e. of the order of 7 to 7.5 degrees, allow the high swing speed, low handicap golfer to overcome the trajectory problem, but in doing so they will strike more errant shots than would have been made if they were to use a higher loft club with a 9 or 10 degree loft angle.

U.S. Pat. No. 5,342,812 of Niskanen et al. describes a golf club head which is entirely or partially made of ceramic or matrix metal composite material. The club head has a hollow body with an open lower end over which a sole plate is secured. Both the body and the sole plate may be of ceramic matrix composite material.

SUMMARY OF THE INVENTION

It is an object of the present invention to provide a new and improved golf club head with a higher center of gravity.

According to one aspect of the present invention, a golf club head is provided which comprises a body having a front, striking face, a rear face, an upper face and a lower face, and a sole plate secured across the lower face of the body, the sole plate being of glass fiber reinforced plastic material.

The body may be of injection molded, composite material and the sole plate may also be formed by injection molding. A suitable glass fiber reinforced plastic material for the sole plate which is both strong and relatively lightweight is a glass fiber reinforced polyphenylene sulfide (PPS). The body may be hollow or may contain one or more inserts of cork material, as described in co-pending application Ser. No. 10/219,624 filed Aug. 15, 2002, the contents of which are incorporated herein by reference.

In an exemplary embodiment of the invention, the lower face of the body has a peripheral rim and an opening and the sole plate is secured to the rim by an adhesive so as to extend over the opening. The rim and inner face of the sole plate may have interengageable or mating formations for better alignment and adhesion purposes. In one embodiment, the body has a series of bores or indents while the sole plate has posts which engage in the indents when the sole plate is secured to the body. The sole plate may have one or more strengthening ribs extending across its inner face. Any suitable adhesive may be used to secure the sole plate to the body, such as an epoxy material. The mating surfaces of the body and sole plate may first be roughened for improved adhesion.

The fiber reinforced plastic material of the sole plate is of lighter weight than metal but of equivalent durability. It is also more flexible than metal, allowing it to contract and reshape on impacts at a rate similar to the material of the composite head, reducing the risk of separation of the sole plate from the head. Due to the lighter weight sole plate, the center of gravity of the club head will be higher than for an equivalent metal sole plate. This means that the ball trajectory will be lower, allowing the golfer to use a higher lofted club and still maintain a lower trajectory, thus reducing the margin of error for errant shots. The trajectory for this club head with 9 to 10 degree loft angle will be equivalent to that of a 7 to 7.5 degree loft angle club head with a heavier, metal sole plate. This will enable the golfer to reduce the number of errant shots.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
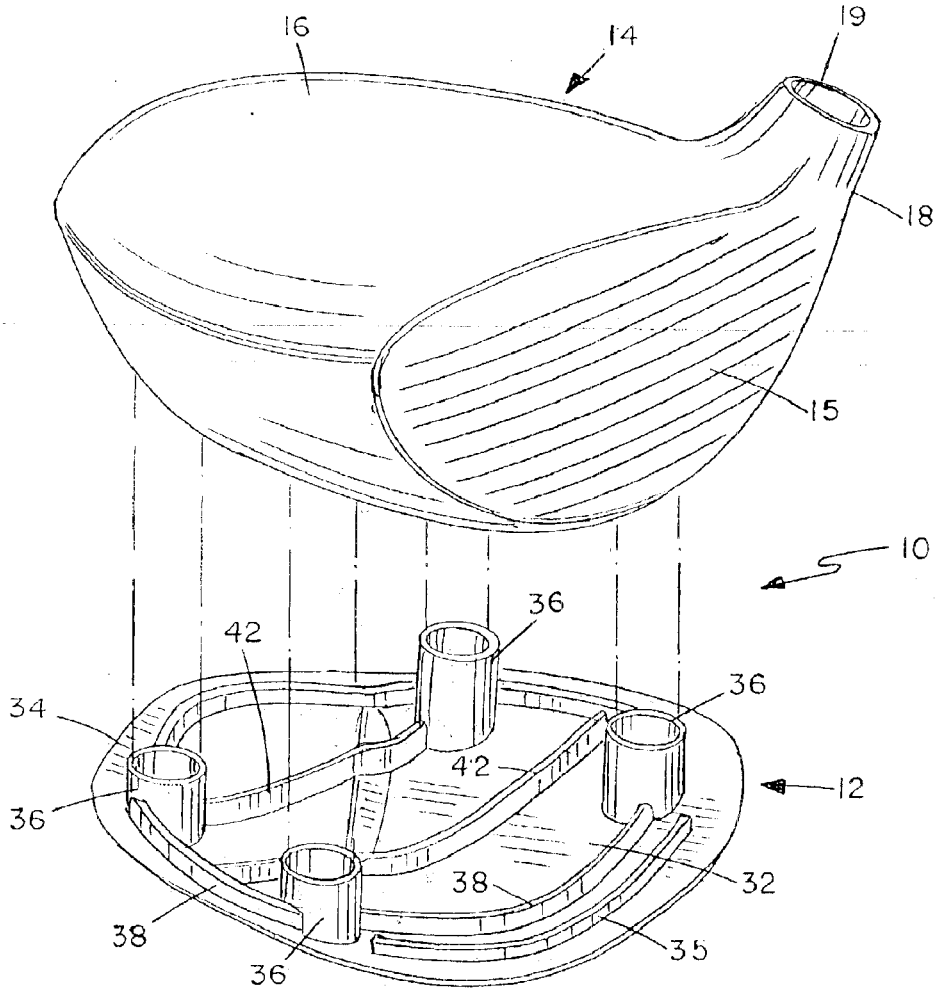
FIG. 1 is a perspective view, from above, of the separated components of a golf club head according to an exemplary embodiment of the invention.
Figure 2:
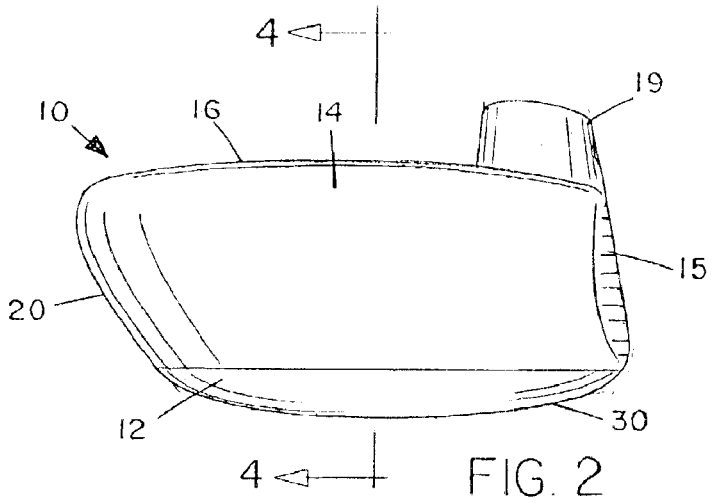
FIG. 2 is a side view of the assembled head.
Figure 3:
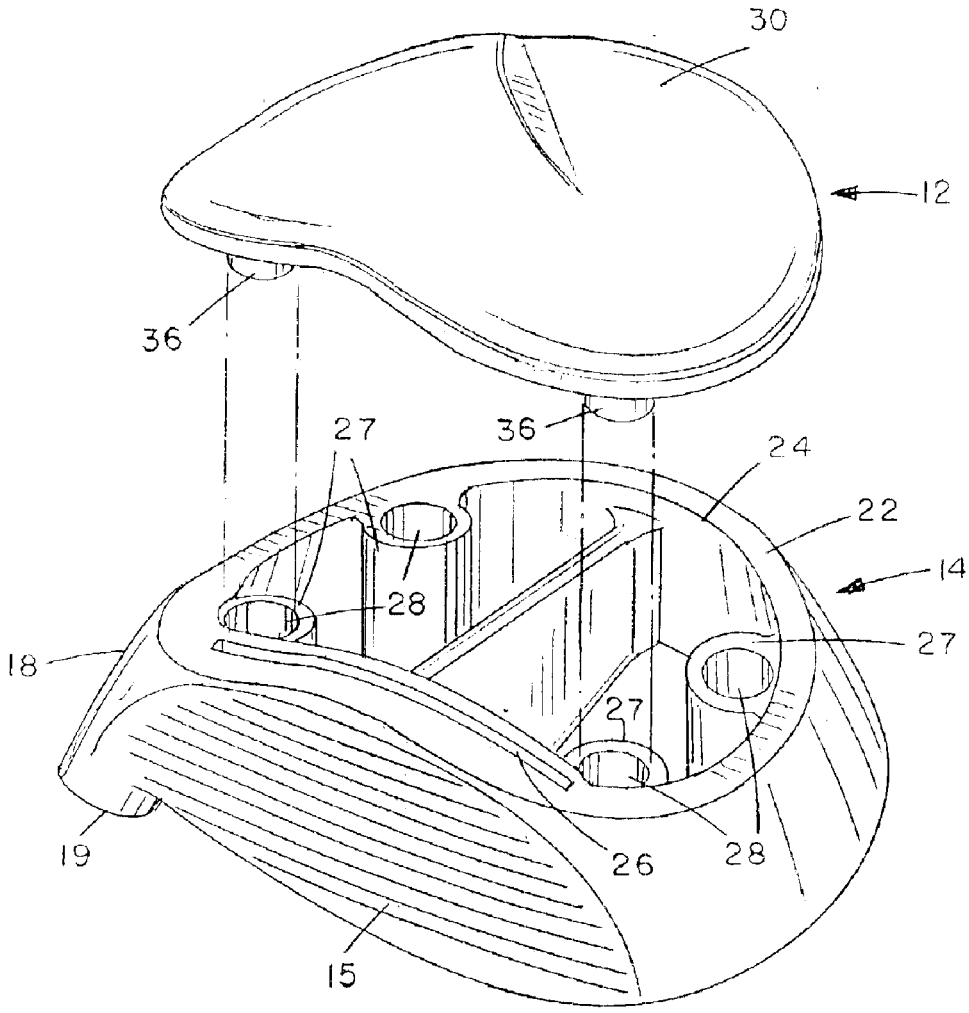
FIG. 3 is a perspective view, from below, of the separated components of the head.

FIGS. 1 to 4 of the drawings illustrate a golf club head 10 according to an exemplary embodiment of the invention with a sole plate 12 of non-metallic, relatively lightweight material such as fiber reinforced plastic material. The head is of a conventional overall shape corresponding to a wood or driver, but it will be understood that other types of golf club heads, such as putters, irons, fairway clubs, or the like, may also be provided with a sole plate of similar material.

The club head 10 has a hollow body or shell 14 having a front, striking face 15, an upper wall or crown 16, a heel 18 from which a hosel 19 projects for attachment to a golf club shaft (not illustrated), a rear wall 20, and a lower end having a peripheral, generally flat rim 22 and an opening 24. The sole plate 12 is secured over the lower end of the head so as to cover the opening 24. The head may have an empty cavity 25 or may be completely or partially filled with a filler material such as cork (i.e. natural cork and/or synthetic cork), as described in co-pending application Ser. No. 10/219,624, the contents of which are incorporated herein by reference.

The peripheral rim 22 of the body 14 has a generally linear slot or groove 26 adjacent the front or striking face 15, but is otherwise generally flat. The internal cavity has four spaced, generally cylindrical posts 27 spaced around the inner peripheral wall adjacent peripheral rim 22, with the upper ends of the posts recessed below rim 22. Each post has a bore 28 with an open upper end.

Figure 4:
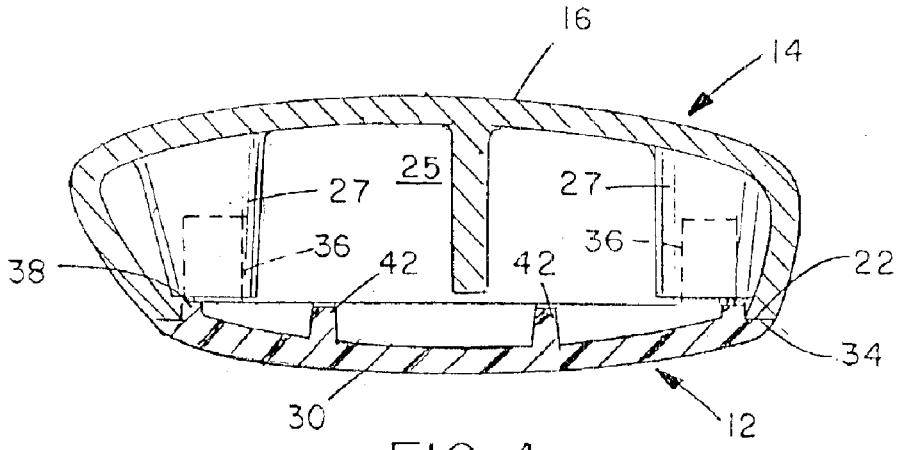
FIG. 4 is a sectional view taken on line 4—4 of FIG. 2.

The sole plate 12 has a generally smooth, slightly curved lower or outer face 30, an inner face 32, and a peripheral edge 34 with a contour substantially matching that of the edge of the peripheral rim 22 of the lower end of the body. A rib 35 projects from the inner face 32 at a location corresponding to the front edge of the plate, and is positioned for mating engagement in the corresponding groove 26 in rim 22. A series of four spaced hollow posts 36 project from the inner face for mating engagement in the bores 28 in the body when the parts are mated together, as indicated in FIG. 4. Ribs or ridges 38 extend between each adjacent pair of posts 36, and the ribs fit inside the rim 22 when the parts are secured together with the flat outer rim of the sole plate in face-to-face mating engagement with the flat rim 22 of the head, as indicated in FIG. 4. Although the parts may be secured together by means of screw fasteners, ultrasonic welding, or the like, in the exemplary embodiment they are secured by a layer of adhesive material applied between the peripheral flat rims of the head and sole plate, on the posts, and on the ridges or ribs 38 where they contact the inner wall of the head cavity.

In addition to the ribs or ridges 38 extending between the posts, the inner face of the sole plate also has two transverse strengthening ribs 42 extending generally parallel to the rib 35 across the inner surface of the plate. This provides additional strength and durability to the plate, and allows the overall sole plate thickness to be reduced. In an exemplary embodiment of the invention, the sole plate thickness was in the range from 0.06 inches to 0.125 inches.

As noted above, the plate is formed from a non-metallic material which is lighter weight than metal, such as a reinforced plastic material. The plate may be made by injection molding. One suitable plastic material for the sole plate is glass fiber reinforced polyphenyl sulfide (PPS), for example the Ryton® Series Compounds produced by Chevron Phillips Chemical Company of Texas. Some examples of suitable Ryton® compounds are Ryton R-4-200BL, Ryton R-4, Ryton R-4 02, or Ryton BR42C having a glass fiber content of 5% to 50% by weight. In an exemplary embodiment of the invention, the glass fiber content was 30% to 50% by weight in order to provide sufficient strength and durability to the plastic material while providing equivalent flexibility to the material used to make the body 14 of the club head. In one specific example of the invention, the sole plate was made by injection molding of Ryton BR42C which is a glass fiber reinforced PPS with a polytetrafluoroethylene (PTFE) additive, with a glass fiber content of 30% to 50% by weight and a PTFE content of 1% to 20% by weight.

The shell or body 14 of the club head is also injection molded from a ceramic composite material. A suitable adhesive material for the bonding layer securing the sole plate of Ryton® PPS to a ceramic composite material head is an epoxy adhesive, for example a two part epoxy. In one particular example, Fusor® (75-42 A/E) manufactured by Lord Corp. of Cary, N.C. was used for the bonding layer. For better adhesion, the mating surfaces of the head and sole plate are cleaned and roughened prior to application of the adhesive layer. For example the peripheral rim 22 of the head and the corresponding peripheral rim region of the sole plate may be chemically treated or etched to provide surface roughness. This will increase the bonding surface area and improve the bond strength.

The golf club head with a sole plate of fiber reinforced plastic material such as Ryton® PPS will provide for greater shot accuracy than a club head with a heavier, metal sole plate. The lighter sole plate will produce a higher center of gravity, which in turn will produce a lower golf ball trajectory. This means that the golfer can use a club head with a higher loft angle, reducing the number of errant shots, instead of having to use a lower loft club to overcome the high trajectory result of a conventional, metal sole plate. The sole plate is light and durable, and the strengthening ribs allow the sole plate to be made thinner overall, and thus of even lighter weight. The bonding of the sole plate to the body with an adhesive material, rather than screws or the like, further reduces the overall weight at the sole of the club.

Another advantage of the material used for the sole plate is that it will be more flexible than a conventional metal sole plate. This allows it to contract and reshape on impact of the head with a ball, at a rate similar to that of the composite body or shell. This reduces the risk of separation of the sole plate from the body. This risk of separation is further reduced by the interengaging formations between the sole plate and body, such as the posts which extend into bores in the body, and the rib which engages the groove in the rim of the lower end of the body. Thus, the body and sole plate are securely connected together.

Although an exemplary embodiment of the invention has been described above by way of example only, it will be understood by those skilled in the field that modifications may be made to the disclosed embodiment without departing from the scope of the invention, which is defined by the appended claims.

We claim:

1. A golf club head, comprising:

a body having a front, striking face, a rear face, an upper face and a lower face;

a sole plate secured across the lower face of the body, the sole plate being made entirely of a first material comprising glass fiber reinforced polyphenylene sulfide (PPS);

the body being made entirely of a second material different from the first material and the first material being lighter in weight than the second material, whereby the center of gravity of the club head is raised.

2. The club head as claimed in claim 1, wherein the glass fiber reinforced PPS has an additive of polytetrafluoroethylene (PTFE).

3. The club head as claimed in claim 2, wherein the PTFE content is 1% to 20% by weight.

4. The club head as claimed in claim 1, wherein the glass fiber content of the fiber reinforced PPS is in the range from 5% to 50% by weight.

5. The club head as claimed in claim 4, wherein the glass fiber content is in the range from 30% to 50% by weight.

6. The club head as claimed in claim 1, wherein the sole plate has an inner face and an outer face, and at least two spaced strengthening ribs are provided across the inner face.

7. The club head as claimed in claim 1, wherein the sole plate is of injection molded material.

8. The club head as claimed in claim 1, wherein the lower face of the body has a peripheral rim and an opening, the sole plate having a rim for securing around the peripheral rim of the body, and an adhesive bonding layer is provided between the peripheral rim of the body and sole plate to secure the sole plate to the body.

9. The club head as claimed in claim 1, wherein the lower face of the body has a first set of spaced, mating formations and the sole plate has an inner face having a second set of corresponding formations for mating engagement with the first set of mating formations on the lower face of the body.

10. The club head as claimed in claim 1, wherein the lower face of the body has a peripheral rim and an opening, the sole plate as an inner face, an outer face, an outer peripheral edge, and a peripheral region adjacent the outer peripheral edge, and at least one peripheral rib extends around at least part of the peripheral region of the inner face of the sole plate, the peripheral rib engaging inside the opening adjacent the peripheral rim of the lower face of the body.

11. The club head as claimed in claim 1, wherein the lower face of the body has a peripheral rim and an opening and the sole plate has an inner face having a peripheral rim secured around the peripheral rim of the body, the peripheral rim of the body having a first mating formation adjacent said striking face and the peripheral rim of the inner face of the sole plate having a second, mating formation engaged with said first mating formation.

12. The club head as claimed in claim 11, wherein the first mating formation comprises a groove and the second mating formation comprises a rib for engagement in said groove.

13. The club head as claimed in claim 1, wherein the lower face of the body has a peripheral rim and an opening and the sole plate has an inner face having a peripheral rim secured around the peripheral rim of the body the lower face of the body having a series of spaced bores and the inner face of sole plate having a series of integral posts projecting outwardly from said inner face and being in press fit mating engagement in said bores.

14. A golf club head, comprising:

a body having a front, striking face, a rear face, an upper face and a lower face;

a sole plate secured across the lower face of the body;

the lower face of the body having a peripheral rim and an opening;

the sole plate having a rim for securing around the peripheral rim of the body;

an adhesive bonding layer being provided between the peripheral rim of the body and sole plate to secure the sole plate to the body;

the body and sole plate being made of different materials;

the sole plate being made entirely of glass fiber reinforced polyphenylene sulfide (PPS); and the body being made entirely of injection molded, ceramic composite material and the adhesive bonding layer being of epoxy material.

15. A golf club head, comprising:

a body having a front, striking face, a rear face, an upper face and a lower face, the body being made entirely of a first material;

a sole plate secured across the lower face of the body, the sole plate being made entirely of a second material different from the first material, the second material comprising glass fiber reinforced plastic material; and the lower face of the body having a first set of spaced, mating formations and the sole plate having an inner face having a second set of corresponding formations for mating engagement with the first set of mating formations on the lower face of the body;

wherein the first set of mating formations comprises a plurality of bores and the second set of mating formations comprises a plurality of posts formed integrally with the sole plate and projecting from the inner face of the sole plate for mating engagement in said bores, the posts being engaged axially in the bores and secured in the bores by adhesive.

16. A golf club head, comprising:

a body having a front, striking face, a rear face, an upper face and lower face;

a sole plate secured across the lower face of the body, the sole plate being made entirely of glass fiber reinforced polyphenylene sulfide (PPS);

the lower face of the body having a peripheral rim and an opening and the sole plate having an inner face having a peripheral rim secured around the peripheral rim of the body;

the lower face of the body having a series of spaced bores and the inner face of sole plate having a series of integral posts projecting outwardly from said inner face and positioned for press fit mating engagement in said bores; and the bores being located at spaced intervals around said opening and adjacent said peripheral rim, and the lower face of the body having a rib extending between each adjacent pair of posts and engaging inside the peripheral rim of the lower face of the body when the posts are engaged in said bores.

* * * * *